US005449037A

United States Patent [19]

Welkey

[11] Patent Number: 5,449,037

[45] Date of Patent: Sep. 12, 1995

[54] HEAT EXCHANGER TUBE SPACER, SEPARATOR, AND SUPPORT

[75] Inventor: Joseph J. Welkey, Houston, Tex.

[73] Assignee: Brown Fintube Corporation, Houston, Tex.

[21] Appl. No.: 164,397

[22] Filed: Dec. 8, 1993

[51] Int. Cl.[6] ..... F28F 9/013

[52] U.S. Cl. ..... 165/162; 122/510

[58] Field of Search ..... 165/159, 162; 122/510

[56] References Cited

U.S. PATENT DOCUMENTS

| | | | |
|---|---|---|---|
| 3,144,081 | 8/1964 | Skiba | 165/162 |
| 3,164,529 | 1/1965 | Waine et al. | 122/510 X |
| 3,240,681 | 3/1966 | Waine et al. | 165/162 |
| 3,858,646 | 1/1975 | Naylor | 165/162 X |
| 4,456,058 | 6/1984 | Powell | 165/162 X |

FOREIGN PATENT DOCUMENTS

| | | | |
|---|---|---|---|
| 105938 | 4/1984 | European Pat. Off. | 165/162 |
| 1368511 | 6/1964 | France | 165/162 |

*Primary Examiner*—Martin P. Schwadron
*Assistant Examiner*—L. R. Leo
*Attorney, Agent, or Firm*—Bernard A. Reiter; Mark L. Berrier

[57] ABSTRACT

Disclosed is a device for supporting and spacing the tubes within a heat exchanger comprised of a plurality of V-shaped stiff wire rods. Each of the V-shaped wire rods includes a pair of leg portions and a concave intermediate section. The inside radius of the concave intermediate section is substantially equivalent to one-half of the tube outside diameter. Six of the V-shaped stiff wire rods are affixed to one another to form a spacer having a substantially hexagonal opening wherein each side of the hexagonal opening is one of the concave intermediate sections. At each apex of the substantially hexagonal opening there extends radially outward legs from two of abutting V-shaped stiff wire rods.

Thus formed, the spacer of the present invention provides a structurally sound tube supporting device while limiting the obstruction to flow of shell side process fluid.

5 Claims, 2 Drawing Sheets

HEAT EXCHANGER TUBE SPACER, SEPARATOR, AND SUPPORT

BACKGROUND OF THE INVENTION

1. Field of the Invention

This invention relates generally to heat exchangers and, more particularly, to tube spacers and supports used in the exchangers.

2. Brief Description of Prior Art

There are a variety of heat exchanger tube support and tube spacing devices in the prior art. One such device is shown in U.S. Pat. No. 2,198,529 to Fields. Fields teaches the spacing of tubes through the use of a series of rollers or rods which reside in perpendicular relationship to the tubes. U-shaped members are then employed to fix the position of the tubes at the point where the tubes cross the rollers.

U.S. Pat. No. 3,144,081 to Skiba teaches a tube spacing means comprised of a central tubular member, a plurality of relatively deep V-shaped channel members and a plurality of relatively short V-shaped channel members. The deep V-shaped channel and the short V-shaped channel members are arranged in alternating relationship about the circumference of the central tubular member.

There is shown in U.S. Pat. No. 3,265,128 to LeGrand a series of baffle or guide plates used to achieve the desired circulation within a shell and tube heat exchanger. Each baffle or guide plate is generally hexagonal in shape and is provided with a generally hexagonal shape of the baffle. Each of these notches receives an individual tube.

U.S. Pat. No. 3,837,397 to Pettigrew discloses the use of two transversely oriented sets of what are apparently flexible wire cables to create a lattice arrangement. This lattice arrangement is used to support the tubes in the heat exchanger.

Another type of tube support is shown in U.S. Pat. No. 2,893,698 to Nunninghoff. Nunninghoff employs or teaches an anchoring piece which has a J-type hook on each end. The J-type hooks on each end of the anchoring piece are rotated 90 degrees from one another. One J-type hook of the anchoring piece encircles a tube while the opposite J-type hook of the anchoring piece engages a thin attached to a second tube running perpendicularly to the first tube thus locking the two tubes in a fixed position with one another.

SUMMARY OF THE INVENTION

It is therefore an object of the present invention to provide a relatively simple spacer and support member for use in conjunction with tubes within a heat exchanger.

Another object of the present invention is to provide a tube spacer and support member which reduces the misalignment and collapsing tendencies of the prior art baffle generally used which was comprised of an annular ring with thin members welded thereto and extending radially therefrom.

Still a further object of the present invention is to provide a tube spacer and support member which has enhanced load carrying capacity.

A further object of the present invention is to provide a tube spacer and support member which is relatively economical to fabricate.

Briefly stated, the foregoing and numerous other objects, features and advantages of present invention are accomplished through the use of plurality of stiff heavy wires or rods. Each stiff heavy wire or rod is bent to form what is substantially a V-shape with a rounded bottom. The angle of bend of each V-shape is approximately 60 degrees. Thus, six of the V-shaped stiff wire members can be placed in a butting relationship wherein the side of one V-shaped rod resides adjacent to a side of a second V-shaped rod thus forming a substantially star-like arrangement. The six V-shaped rods, although interconnected, reside substantially in two parallel planes wherein every other V-shaped rod of the spacer resides in substantially the same plane. This arrangement creates a substantially hexagonal central opening where the sides of the hexagon are comprised of a single rod of concave shape. Extending radially outward from each apex of the hexagon are a pair of stiff wires or rods which are actually the sides of the V-shaped members.

DESCRIPTION OF THE PREFERRED EMBODIMENT

Figure 1:
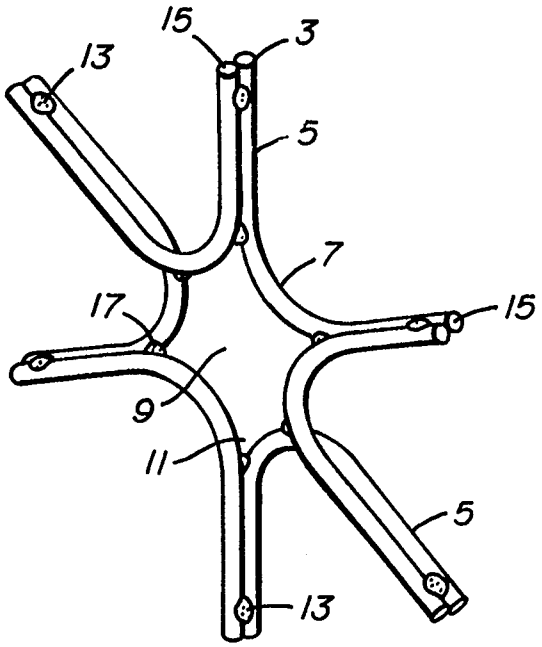
FIG. 1 is an isometric view of the tube spacer and support device of the present invention.

Referring first to FIG. 1, there is shown the tube support and spacer device 1 of the present invention. Such tube support and spacer device 1 is comprised of six V-shaped stiff wire rods 3. Each V-shaped stiff wire rod 3 includes leg sections 5 and concave intermediate sections 7. The angle between leg sections 5 of any one V-shaped stiff wire rod 3 is substantially equal to 60 degrees.

Each V-shaped stiff wire rod 3 is positioned such that its legs 5 residing in abutting position with a leg 5 of the immediately adjacent stiff wire rod 3. The six stiff wire rods 3 reside in substantially two different planes in an alternating relationship such that each stiff wire rod 3 resides in a different plane from the plane in which the immediately adjacent stiff wire rods 3 reside. This arrangement creates a tube spacer and support device having a generally six-pointed star configuration. At the center of the spacer 1 is a generally hexagonal opening 9. Each side of the hexagonal opening 9 is comprised of intermediate concave section 7 thereby creating a generally hexagonal shape of concave sides. A pair of legs 5 extend radially outward from each apex 11 of generally hexagonal opening 9.

Adjacent V-shaped stiff wire rods 3 are connected by means of spot welding. Preferably there will be one spot weld 13 located near the ends 15 of the V-shaped stiff wire rods 3. A second spot weld 17 is preferably located near the apexes 11 of generally hexagonal opening 9.

Figure 2:
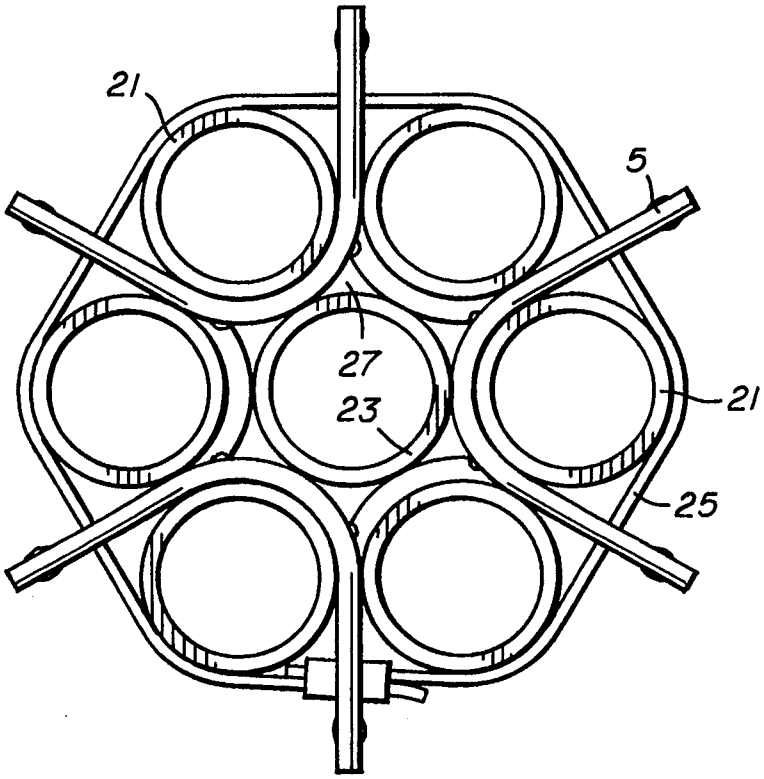
FIG. 2 is a sectional view of a bundle of seven tubes supported and spaced by the tube spacer and support device of the present invention.
Figure 3:
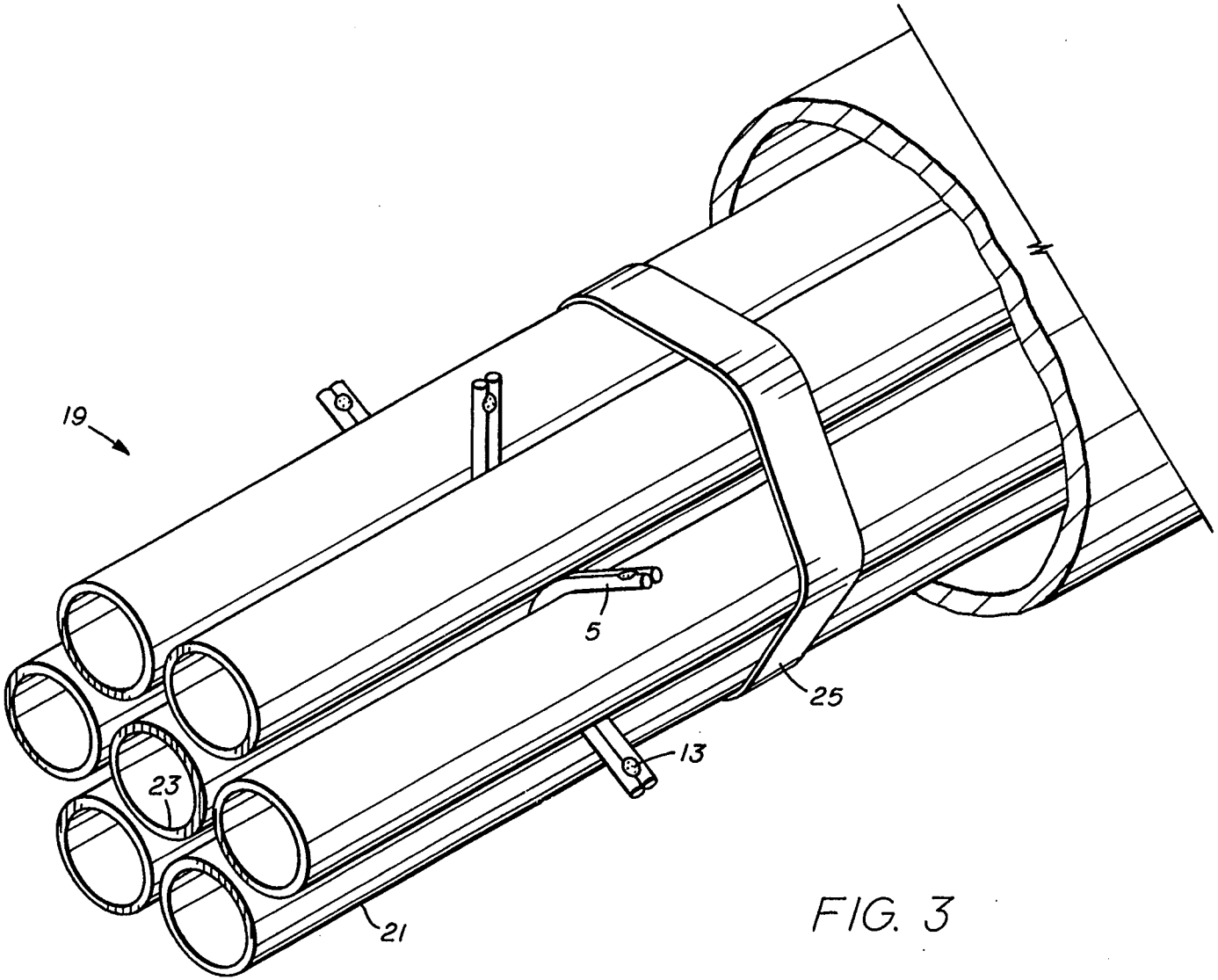
FIG. 3 is an isometric view of a bundle of seven tubes within a heat exchanger supported and spaced by the tube spacer and support device of the present invention.

Referring next to FIG. 2 and 3, the tube spacer and support device 1 is depicted in place with a 7 tube bundle 19. The 7 tube bundle 19 is comprised of 6 outer tubes 21 and a single inner tube 23. The 7 tube bundle 19 is held together by band 25.

The inside radius of curvature of each intermediate concave section 7 is substantially equivalent to the outside radius of tubes 21 and 23. Thus, each V-shaped stiff wire rod 3 contacts its accompanying outer tube 21 over an arc length equal to approximately one-sixth of tubes 21 creating a solid load bearing and spacer interface between outer tubes 21 and inner tube 23. Legs 5 provide a rigid load bearing interface between outer tubes 21.

Referring specifically to FIG. 2, it should be seen that the arrangement of tube bundle 19 utilizing spacer 1 yields a series of substantially triangular openings 27 between inner tube 23 and intermediate concave sections 7. The substantially triangular openings 27 allow flow of shell side process fluid between the spacer 1 and inner tube 23. Similarly, the radially extending legs 5 minimize flow restriction of shell side process fluid which can typically be caused by many of the spacers in the prior art.

The rigidity and strength of V-shaped stiff wire rods 3 ensure the structural stability of the spacer 1 of the present invention. The legs 5 will not collapse or break off as was common with the fins of previously employed spacers. The fragility of the fins of the typically used prior art spacers was responsible for their tendency to either fold or break. This folding or breaking of the fins often resulted in a collapse of the tube bundle allowing the tube bundle to fall down within the shell leaving the upper part of the shell open to flow thus severely reducing the efficiency of the heat exchanger. The stability created by the V-shaped stiff wire rods 3 with concave intermediate sections 7 arranged to form a substantially hexagonal opening 9 prevents this type of structural failure from occurring with the spacer 1 of the present invention. Further, this design provides greater openings and therefore less flow restriction between the tubes 21 and 23 for the shell side process fluid.

From the foregoing, it will be seen that this invention is one well adapted to obtain all of the ends and objects herein above set forth, together with other advantages which are obvious and which are inherent to the device.

It is to be understood that certain features and subcombinations are of utility and may be employed with reference to other features and subcombinations. This is contemplated by and used within the scope of the claims.

As many possible embodiments may be made of the invention without departing from the scope thereof, it is to be understood that all matter herein set forth or shown in the accompanying drawings is to be interpreted as illustrative and not in eliminating sense.

What is claimed is:

1. A tube spacer and tube support device for use in heat exchangers comprising:

six V-shaped stiff wire rods, each of said V-shaped stiff wire rods having two leg portions and a concave intermediate section having an inside radius of curvature which is substantially equivalent to an outside radius of a tube;

said V-shaped stiff wire rods connected to form a substantially hexagonal opening having six apexes wherein each side of said substantially hexagonal opening is one of said concave intermediate sections and wherein one of said leg portions of each of said V-shaped stiff wire rods is affixed to one of said leg portions of an immediately adjacent V-shaped stiff wire rod so that two of said leg portions extend radially outward from each of said apexes of said substantially hexagonal openings.

2. A device for supporting and spacing tubes within a heat exchanger comprising:

six V-shaped stiff wire rods, each of said V-shaped stiff wire rods having two leg sections and a concave intermediate section having an inside radius of curvature which is substantially equivalent to an outside radius of a tube;

said leg sections of each of said V-shaped wire rods having an angle of approximately 60 degrees there between;

said V-shaped stiff wire rods arranged and connected to one another to form said spacer with an opening having six apexes;

two of said leg sections extending radially outward from and in parallel relation to each of said apexes.

3. A device for supporting and spacing tubes within a heat exchanger as recited in claim two wherein:

said opening has six sides, each of said sides being one of said concave intermediate sections.

4. A device for supporting and spacing tubes within a heat exchanger as recited in claim two further comprising:

a plurality of substantially triangular openings between the tube inserted in said opening and said apexes.

5. A device for supporting and spacing tubes within a heat exchanger comprising:

(a) a first set of three V-shaped stiff wire rods residing in a first plane;

(b) a second set of three V-shaped stiff wire rods residing in a second plane, said first plane and said second plane being parallel to one another, all of said V-shaped stiff wire rods having two leg portions and a concave intermediate section having an inside radius of curvature which is substantially equivalent to an outside radius of a tube, each of said first set of V-shaped stiff wire rods affixed to two of said second set of V-shaped stiff wire rods;

(c) a substantially hexagonal opening in said spacer wherein each side of said substantially hexagonal opening is one of said intermediate sections.

* * * * *